United States Patent [19]

Swenson

[11] 4,310,977

[45] Jan. 19, 1982

[54] DISPOSABLE SCROLL HOLDER

[76] Inventor: Robert Swenson, 1932 Utica Pike, Jeffersonville, Ind. 47130

[21] Appl. No.: 191,179

[22] Filed: Sep. 26, 1980

[51] Int. Cl.[3] ..... G09F 11/18; G09F 11/12

[52] U.S. Cl. ..... 40/518; 40/524

[58] Field of Search ..... 40/518, 514, 515–517, 40/519–523; 46/1 L; 434/426

[56] References Cited

U.S. PATENT DOCUMENTS

| | | | |
|---|---|---|---|
| 770,841 | 9/1904 | Barker | 434/426 |
| 1,966,276 | 7/1934 | Armstrong | 40/514 |
| 3,581,431 | 6/1971 | Trenovan | 46/1 L |
| 3,928,926 | 12/1975 | Carrivean | 40/518 |
| 3,991,498 | 11/1976 | Beach | 40/518 |

*Primary Examiner*—Robert Peshock
*Assistant Examiner*—Michael J. Foycik

[57] ABSTRACT

A display device for displaying a scroll including a case defined from a single blank of stiff planar material where the blank in assembled form provides a base, a top having a viewing area, an internal platen exposed immediately beneath the viewing area where roller receiving chambers are defined on each side of the platen so that a scroll or paper strip can be moved between roller members disposed in the chambers on either side of the platen.

1 Claim, 5 Drawing Figures

DISPOSABLE SCROLL HOLDER

BACKGROUND OF THE INVENTION

The present invention relates to devices useful in displaying scroll type assemblies where paper and other planar material is retained on one roller device and unwound through the device for viewing by means of a viewing area and then rewound on a roller disposed on the opposite side of the viewing area. The prior art includes devices as shown in my U.S. Pat. No. 4,277,033, where a hard plastic case is provided having a removable top and where a scroll supply and rewind roll is provided on opposite sides of the platen. While the devices disclosed in my aforenoted patent are useful and find greater application as a toy the devices are somewhat more expensive than the devices of the type provided by the present invention and are generally not considered disposable.

SUMMARY OF INVENTION

The present invention provides a scroll arrangement which is extremely inexpensive to manufacture and is particularly useful as a toy. Devices within the scope of the present invention can be fabricated at a cost low enough that the devices can be considered disposable but can also be reused by simply changing the scroll retained within the device.

Advantageously, scroll holding devices within the scope of the present invention can be easily fabricated from stiff planar material, for example paperboard with one die cutting operation.

Accordingly, devices within the scope of the present invention can be shipped in disassembled form to reduce freight and other costs as well as storage space and then finally assembled by the vendor prior to sale or by the user. Such an arrangement would be particularly usedful where devices within the scope of the present invention are utilized, for example, as free give-away items for children in airlines so that the device could be loaded on the airplane in a dissembled form and assembled by the user as part of the experience of utilizing the device.

More particularly, the present invention provides a scroll receiving and unwinding device including a support structure formed from a planar blank of a stiff material including a generally rectangular planar base with cooperative slot means, first generally rectangular sidewall means including aperature means of first diameter adjacent opposite ends of the first sidewall in centered relation on a line parallel to the first edge of the base means and first and second tab means extending outwardly from first sidewall and generally rectangular planar platen means extending outwardly from a portion of a third edge of the first sidewall having a length along the third edge less than the length of the third edge including first and second platen tab means extending outwardly from first and second generally opposed edges of the platen means where the first and second platen tab means are creased along first and second crease lines extending generally parallel to the first and second platent edges to provide three segments and platen slot means cut in said first crease of each platen tab and generally parallel thereto and where the base means includes first and second end walls extending outwardly from second and third generally opposed edges at the ends of the first edge where the first and second endwalls are provided with first and second crease lines in parallel spaced relation from and parallel to the second and third base edges to define first, second and third endwall segiments and where first and second end tabs are provided respectively at the end of each of the first and second endwalls to be received in the platen slot means when the blank is in assembled form, generally rectangular second sidewall means extending outwardly from a fourth edge of the base means opposite the first edge and between the second and third edges including second and third aperture means at opposite ends of the sidewall each in aligned relation with one of the first and second apertures along lines parallel to the second and third edges of the base means and along a line parallel to the fourth base edge, and third and fourth tab means extending outwardly from opposite edges of the second sidewall means, and generally rectangular top means having perimeter dimensions equal to the base means extending outwardly from a third edge of the second sidewall means opposite the fourth edge of the base means including a central viewing aperture, first and second top tab means extending outwardly from first and second edges of the top at opposite ends of the top and top wall means extending outwardly from a third edge of the top means opposite the third edge of the second sidewall with fastener tab means carried by the outermost edge of the top wall means adapted to be received in the base slot means where the blank can be assembled with the edge of the platen opposite the third edge of the first sidewall abutting the inner surface of the second sidewall adjacent the third edge edge thereof, the platen tab means folded to form channels at opposite ends of the platen with a first segment extending downwardly from the platen to the base, a second segment resting on and parallel to the base and third segiment, so the first and third and second and fourth apertures, respectively are in aligned relation through the channels with the first second third and fourth tabs inturned, the tab folded over the platen, with the first segment of each base endwall turned downwardly so a third platen endwall segment and the first and third tabs and the first top tab are enclosed thereby at one end of the base means and a third platen endwall segment and the second and fourth and second top tab means are enclosed thereby at its opposite end of the base means with the top sidewall means downturned over the first sidewall and the fastener means received in the base slot means. Examples within the scope of the present invention are illustrated in the accompanying figures but it is to be understood that various other arrangements also within the scope of the present invention will occur to those skilled in the art upon reading the disclosure set forth hereinafter.

BRIEF DESCRIPTION OF THE DRAWINGS

Examples within the scope of the present invention are illustrated with respect to the accompanying figures wherein.

Figure 1:
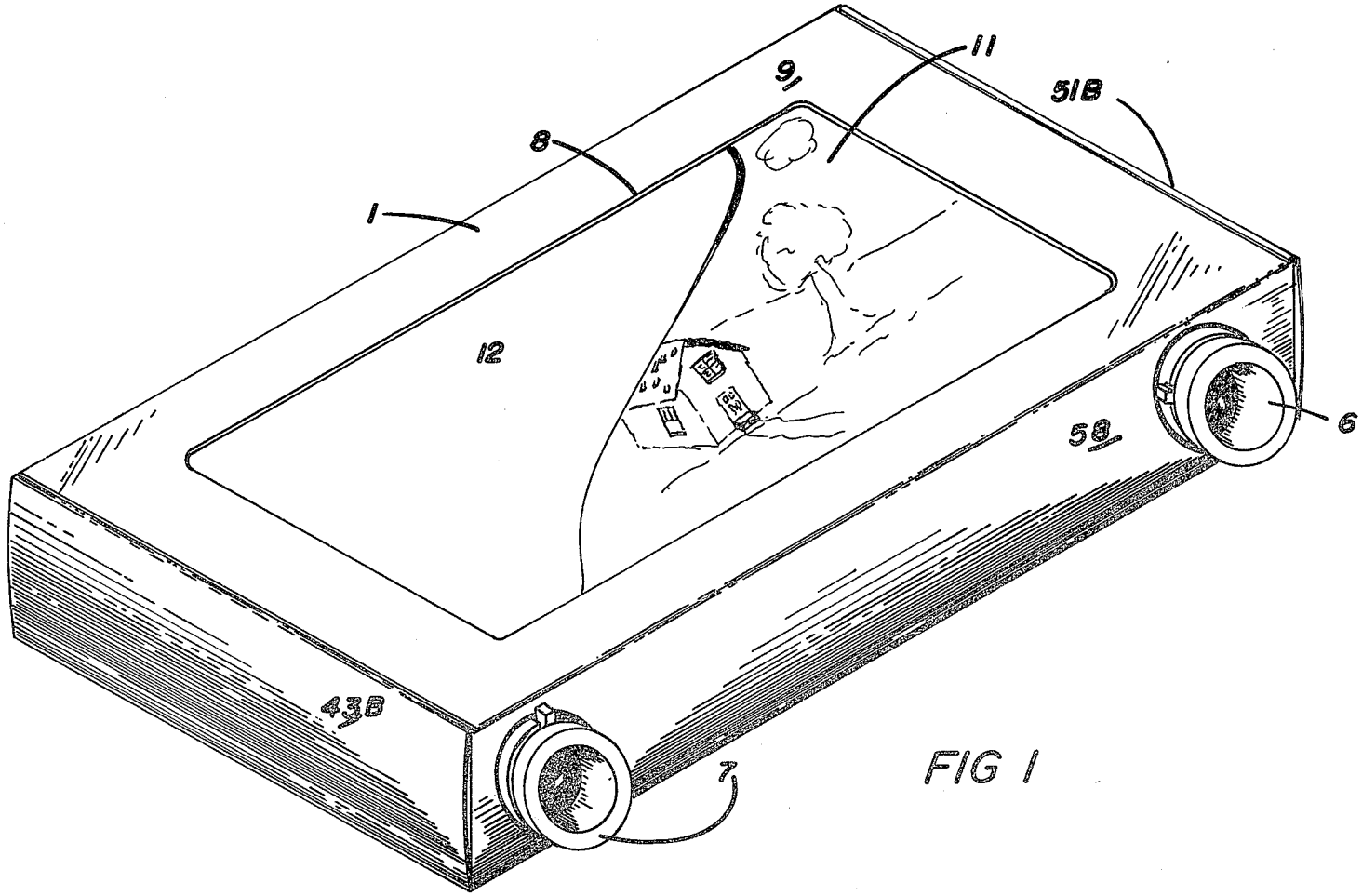
FIG. 1 is a perspective view of an assembled unit within the scope of the present invention.
Figure 4:
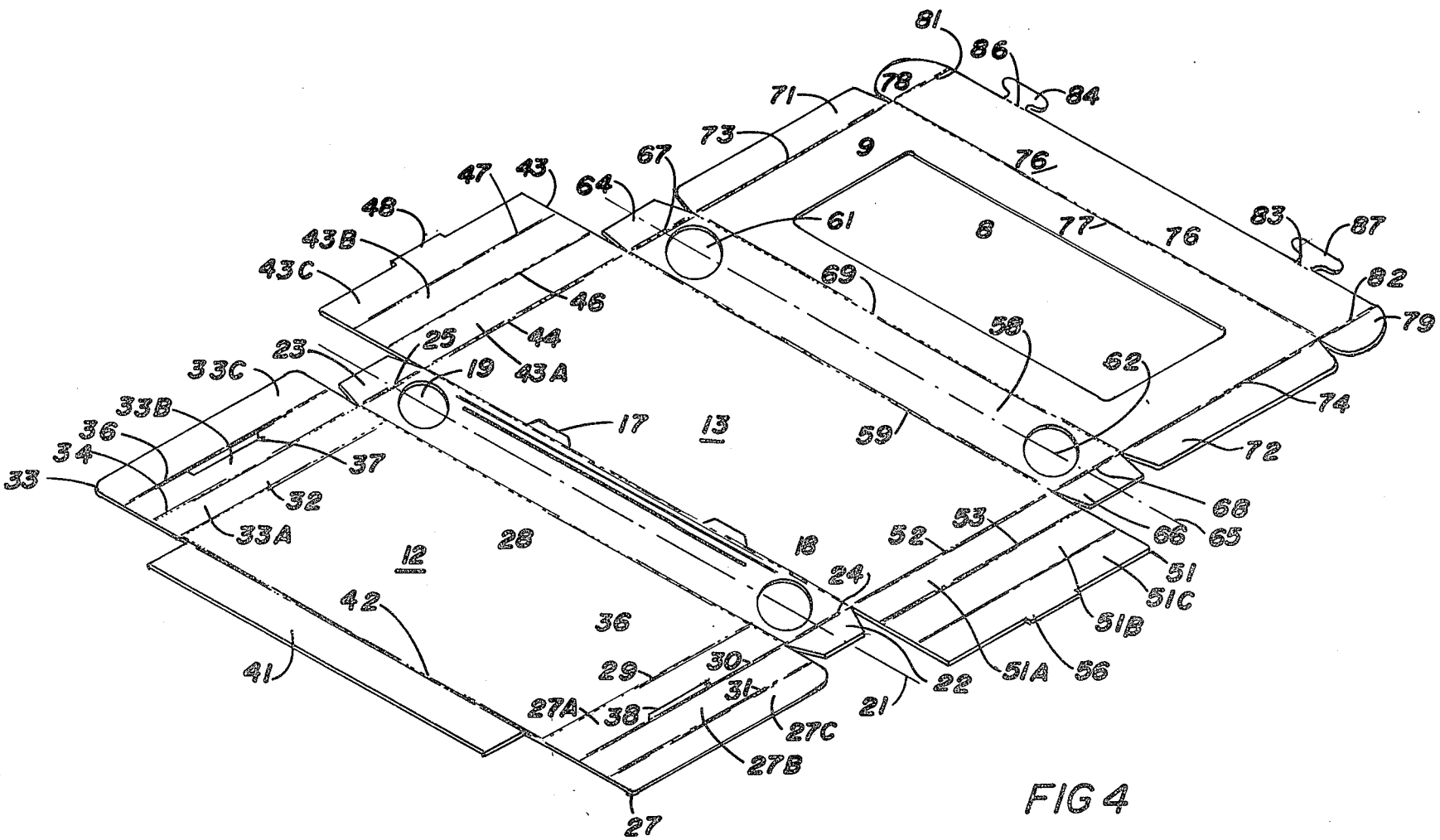

FIGS. *3a–3b* illustrate the assembly steps of an arrangement within the scope of the present invention as shown in FIG. 1;

FIG. 4 is a perspective view of an alternative blank within the scope of the present invention useful in assembling the device of the type shown in FIG. 1.

Referring now to FIG. 1, one example of a device in accordance with the present invention is shown where a casing 1 is provided having end wall 43B and 51B and a front side wall 58 with knobs 6 and 7 protruding therethrough and connected to a scroll winding and unwinding cores for rotation thereof as shown in FIG. 36 as described hereinafter.

A viewing aperture 8 is provided in a top wall 9 where a scroll 11 is provided to be carried at opposite ends by cores described hereinafter and a portion of the scroll is received on a platen 12 defined internally on the casing as described hereinafter.

Figure 2:
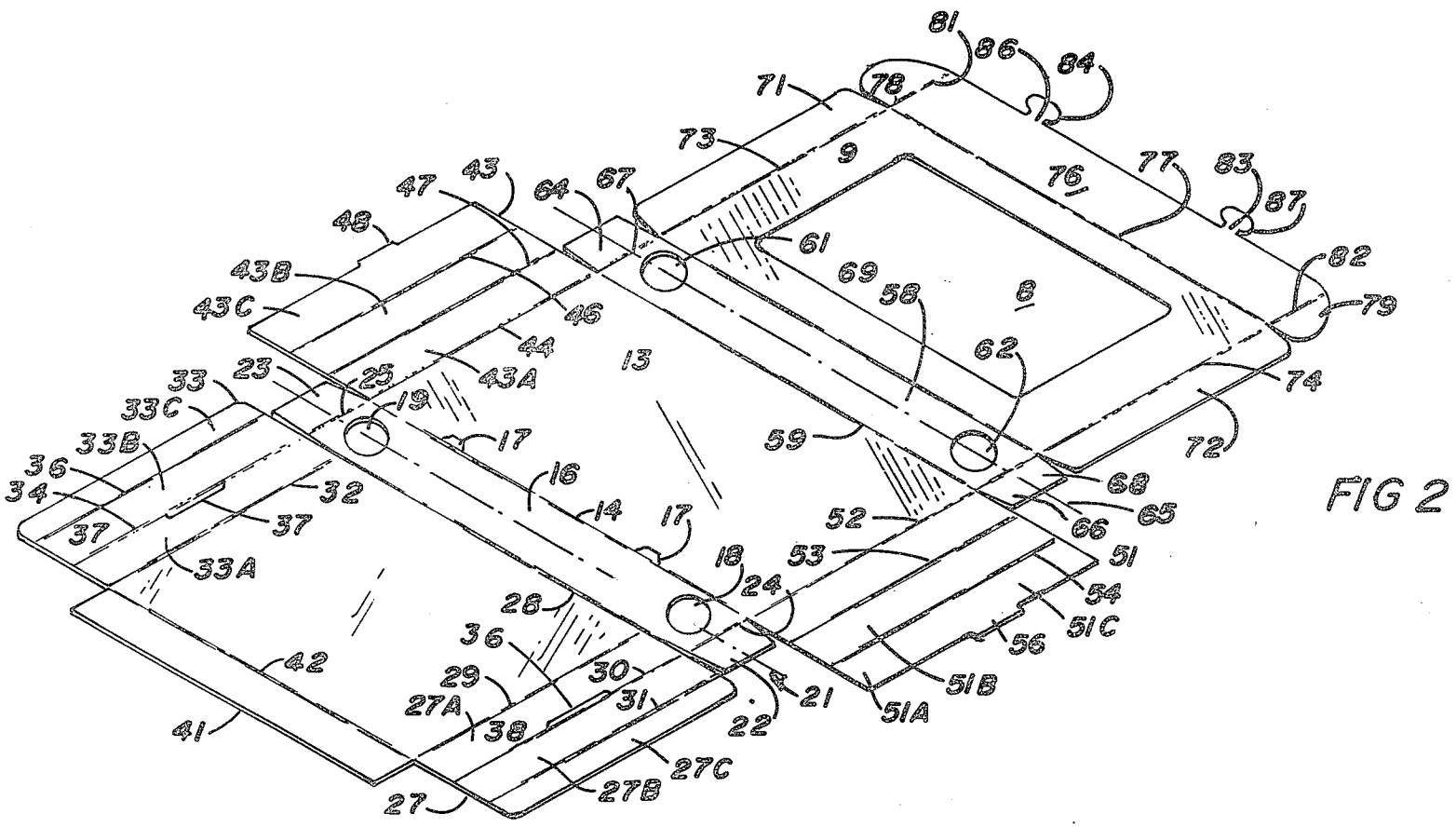
FIG. 2 is a perspective view of a blank useful in assembling the casing provided by the present invention.

Referring to FIG. 2, which is an illustration of the casing of FIG. 1 in unassembled form, it will be seen that the casing is formed entirely from a single flat blank with various folds and tabs as described hereinafter.

A base 13 is provided having a first fold line 14 adjacent one edge where a first side wall 16 extends outwardly therefrom.

Cooperative slots 17 are cut in base 13 to secure the casing together as described hereinafter. Sidewall 16 includes apertures 18 and 19 disposed in spaced relation from fold 14 and centered on a center line 21 as shown, where apertures 18 and 19 are inset from the folds 24 and 25 of sidewalls 16. Tab means 22 and 23 extend outwardly from folds 24 and 25 of opposite ends of sidewall 16. A platen 12 is connected to the fourth edge of sidewall 16 at a fold line 28 and includes a first three section platen tab 27 extending outwardly from platen 12 at fold line 29. Three section platen tab 27 further includes fold lines 30 and 31 which divide the three section platen tab into the three sections 27A, 27B and 27C.

Likewise at the opposite edge of platen 11 a fold line 32 is provided to define a second three section platen tab 33 which extends outwardly therefrom including fold lines 34 and 36 to provide the three sections 33A, 33B and 33C of the three section platen tab 33.

A slot 37 is provided in foldline 34 of tab 33 and a slot 38 is provided in fold line 29 of three section platen tab 27. A fastening tab 41 is provided at the fourth edge of platen 12 and a fold line 42 is provided between the fourth edge of platen 11 and fastening tab 41.

Referring again to base 13, a three section first end wall tab 43 is provided at one edge of base 13 as shown at a fold line 44 between base 13 and first end wall tab 43 which is divided into three sections, 43A, 43B and 43C by foldlines 46 and 47. A tab 48 is provided on the outermost edge of section 43C.

Likewise at the opposite edge of base 13 a three section second end wall tab 51 is provided from a fold line 52 of base 13 and includes three sections 51A, 51B and 51C defined by fold lines 53 and 54. A tab 56 is provided at the outermost edge of section 51C. A second sidewall 58 is provided adjacent the remaining edge of base 13 defined by a fold line 59. Sidewall 58 includes apertures 61 and 62 in generally aligned relation on a center line 63 and inset from the ends of sidewalls 58 where apertures 61 and 62 are respectively in alignment with apertures 19 and 18 of sidewall 16. It will be noted that advantageously, as described in more detail hereinafter the diameter of apertures 61 and 62 is slightly larger than the diameter of apertures 18 and 19.

Tabs 64 and 66 are provided at opposite ends of sidewall 58 and are defined at foldlines 67 and 68 respectively. A foldline 69 is provided at the fourth edge of sidewall 58 to define top 9 where top 9 advantageously provides tabs 71 and 72 at opposite edges thereof defined by foldlines 73 and 74. As shown, viewing aperture 8 is defined within top 9 and where the outer periphery of top 9 is substantially the same as the periphery of base 13.

A top side wall 76 is provided from a fold line 77 at one edge of top 9 and includes edge tabs 78 and 79 defined by foldlines 81–82. Likewise eared tabs 83–84 are provided from the fourth side of top side wall 76 and are defined at foldlines 86–87.

Figure 3A:
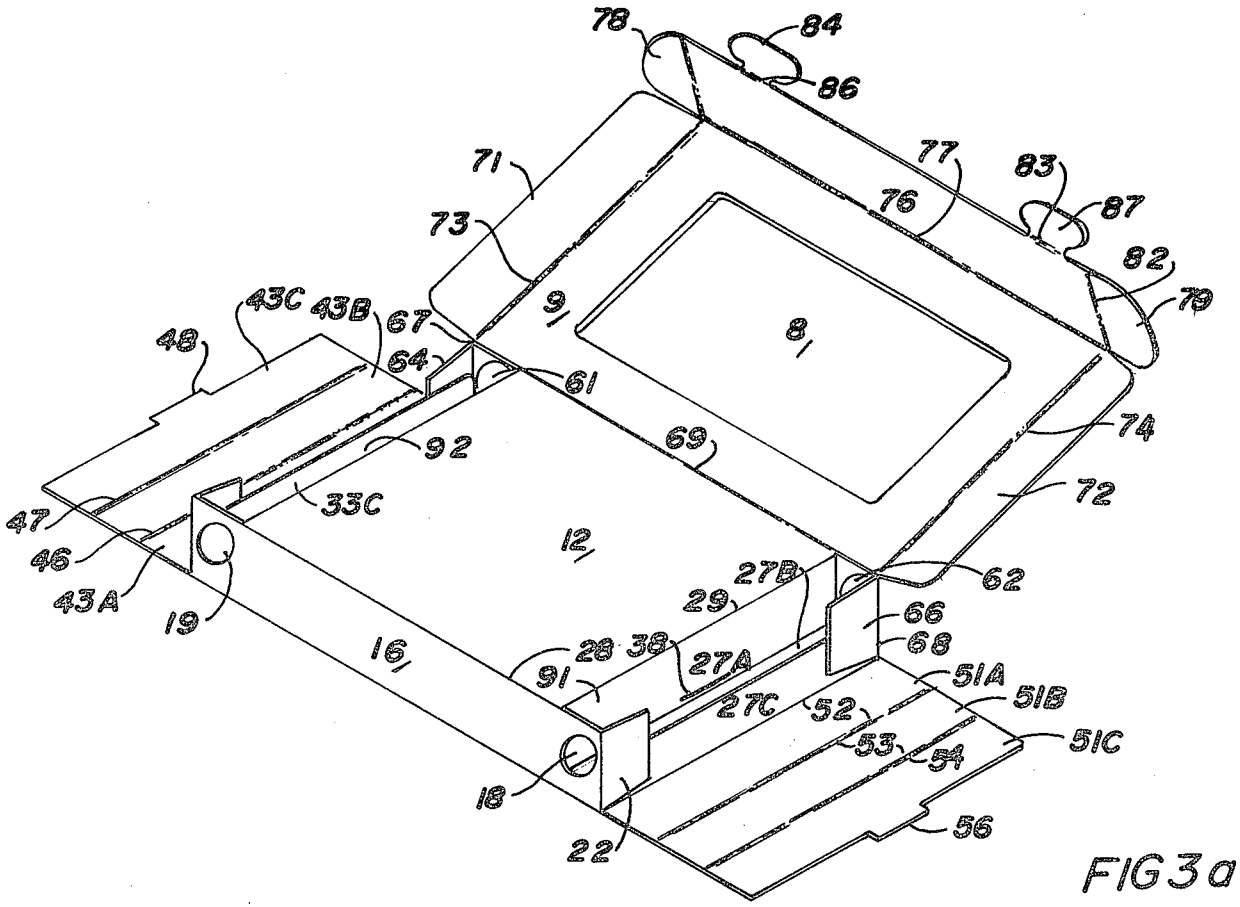
Figure 3B:
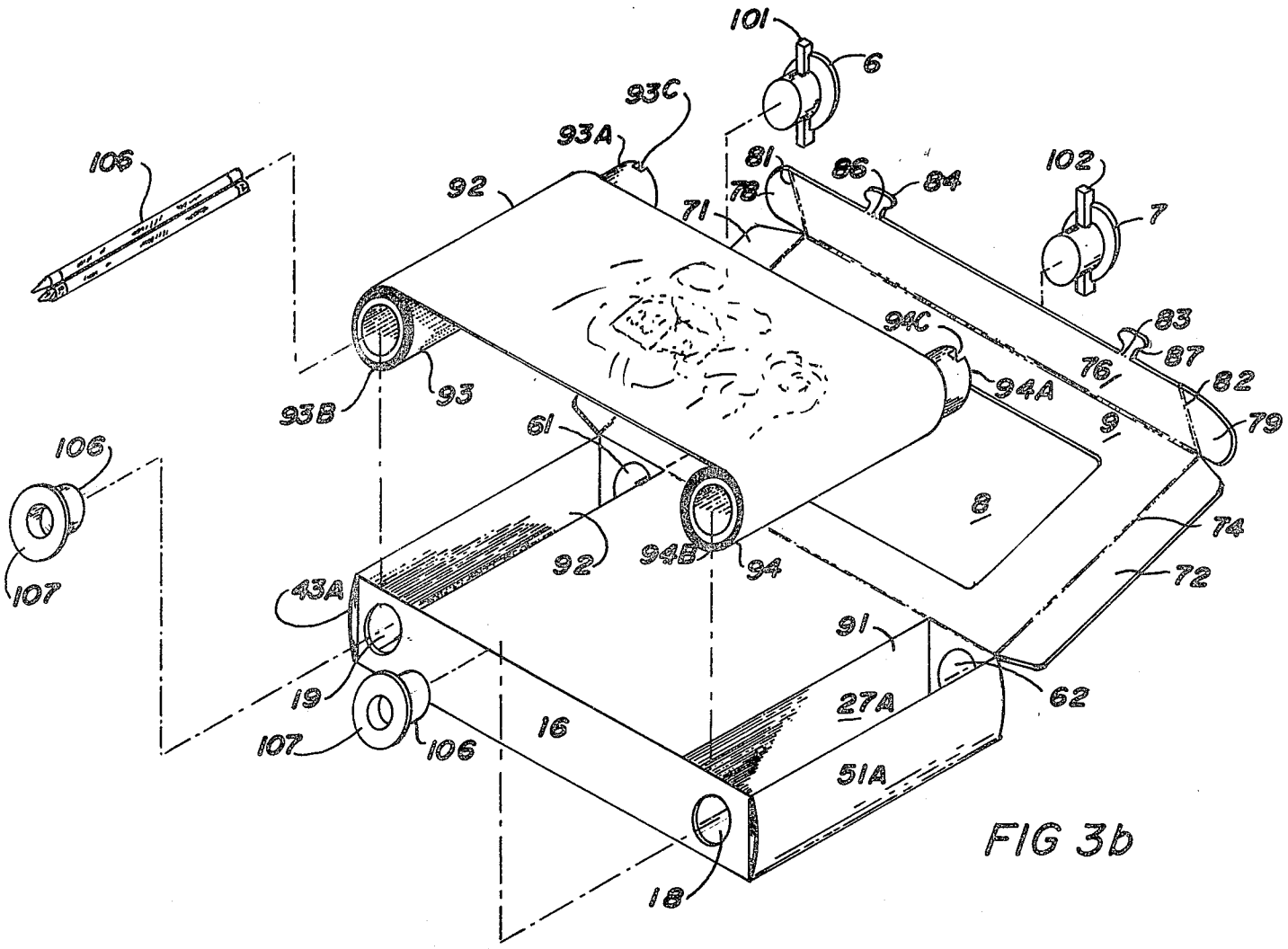

FIGS. 3*a*–3*b* illustrate a method of assembly of the device shown in FIG. 1 in sequential steps where in FIG. 3*a* tab 41 (not shown) has been placed against the inner surface of sidewall 58 and secured, for example, with gluing so that the platen 12 is located immediately beneath fold line 69 of top 9. It will be noted that the length of platen 11 is substantially less than the length of top 9 and base 13 and that platen 11 is located immediately beneath the viewing area 8 to provide a work support for a web 12 section as described hereinafter. Also it will be noted that three section tabs 27 and 33 have been formed into wells 91–92 at opposite ends of platen 11 to receive the ends of scroll means as described hereinafter where tab sections 27A and 23A extend downwardly from foldlines 32 and 28, tab sections 27B and 33B to rest on base 13 and tab sections 27C and 33C extend upwardly so tabs 33B and 27B support the ends of platen 11. Furthermore, the position of slot 38 will be noted and it will be understood that slot 37 of three section tab 33 is in a similar position. Likewise tabs 22 and 29 of sidewall 16 have been inturned to abut tabs 27C and 33C.

Further, tabs 64 and 66 of sidewall 58 have been inturned against surfaces 27C and 33C to provide a similar arrangment.

With reference to FIG. 3B an illustration is shown where the scroll wells have been further formed by turning tab 51 upwardly at foldline 52 so that a segment 51A and 43A to form an end wall with segment 51B extending downwardly so that tab 22 of sidewall 16 and tab 66 of sidewall 58 and segment 27C are enclosed between the tab 51A and 51B.

Likewise tab 51C is located immediately over tab 27B with tab 56 inserted in slot 38 (not shown).

It will be understood that a similar arrangement is provided at the opposite end of the device with respect to three section tab 43. It will be noted that in the arrangement shown that apertures 62 and 18 are in aligned relation in the well 91 formed at the right end of the device and aperture 61 and 19 are in aligned relation in the well 90 formed in the opposite end.

A scroll 92 including a printed web 95 is provided and wound on cores 93 and 94, core 94 having a protruding end 94A and a flush end 94B. Likewise core 93 has a protruding end 93A and an end 93B flush with the edge of web 95.

It will be noted that notches 93C are provided in end 93A of core 93 and notches 94C are provided in end 94C of core 94. The core is inserted in the device with ends 94A and 93A through apertures 61 and 62 and where ends 93B and 94B are flush with the edges of apertures 18 and 19 of sidewall 16.

Knobs 6 and 7 are provided to be received in ends 93A and 94A and include ears 101 and 102 to be received within notches 93C and 94C respectively. Likewise plugs 106 are provided to be received in ends 93B and 94B where a flange 107 is provided on each of the knobs to abut the outside edge of sidewall 16 so that the plugs turn with the cores but retain the roll in aligned relation within wells 91–92. FIG. 1 illustrates the closure of the top where tabs 71–72 (not shown) have been inserted into wells 91–92 to abut tabs 43B and 51B and tabs 83 and 84 are inserted beneath the device in slots 17 provided in base 13.

Additionally it will be noted that cores 93 and 94 are hollow and marking devices 106, for example crayons, can be inserted in the cores 93–94 and retained by plugs 6, 7 and 106.

It has been found that in the arrangement shown the use of plugs 6–7 in cores 93–94 in cooperation with plugs 106 provide an arrangement where the web 12 could be wound between the rolls and selected protions of the scroll can be retained in apertures 8 by means of the friction provided by plugs 106 leaning on endwall 16.

FIG. 4 is an illustration of a device within the scope of the present invention where instead of gluing tab 41 in place, a slot 40 is provided in sidewall 58 so that the tap 41 is inserted through the slot ot hold the platen 12 in assembled form.

It will be understood that the foregoing is but one example of an arrangement within the scope of the present invention and other arrangements also within the scope of the present invention will occur to those skilled in the art upon reading the disclosure set forth hereinbefore.

The invention claimed is:

1. A scroll winding and unwinding device including a support structure formed from a planar blank of a stiff material including a generally rectangular planar base with cooperative slot means, first generally rectangular sidewall means hingedly extending from a first edge of the base means including aperture means of first diameter adjacent opposite ends of the first sidewall in central relation on a line parallel to the first edge of the base means and first and second tab means hingedly extending outwardly from opposed first and second edges of the first side wall and generally rectangular planar platen means hingedly extending outwardly from a portion of the third edge of the first sidewall opposite said first edge of said base means having a length less than the length of the said edge of said first sidewall including first and second platen tab means hingedly extending outwardly from first and second generally opposed edges of the platen means where each of said first and second platen tab means are creased along first and second crease lines extending generally parallel to the first and second platen edges to provide three segments and platen slot means are cut in said first crease and generally parallel thereto and where said base means includes first and second end walls extending hingedly outwardly from second and third generally opposed edges of said base means perpendicular to the ends of the first edge where the first and second endwalls are provided with first and second crease lines in parallel spaced relation from and parallel to the second and third base edges to define base second and third endwall segments and where first and second end tabs are provided respectively at the end of each of the first and second endwall to extend outwardly from the first and second endwalls to be received in the said platen slot means when the blank is in assembled form, generally rectangular second sidewall means extending outwardly from a fourth edge of said base means between the second and third edges of said base means including second and third aperture means at opposite ends of the second sidewall, each in aligned relation with one of the first and second apertures along lines parallel to the second and third edges of the base means and along a line parallel to the fourth base edge, and third and fourth tab means hingedly extending outwardly from opposite edges of the second sidewall means; and generally rectangular top means having dimensions equal to the base means extending outwardly from a third edge of the second sidewall means opposite the fourth edge of the base means including a central viewing aperture, first and second top tab means extending outwardly from first and second edge of the top at opposite ends of the top and top wall means extending outwardly from a third edge of the top means opposite the third edge of the second sidewall with fastener tab means carried by the outermost edge of the top wall means adapted to be received in the base slot means where the blank can be assembled with the edge of the platen opposite the third edge of the first sidewall abutting the innermost surface of the second sidewall adjacent the third edge thereof, the platen tab means folded to form channels at opposite ends of the platen with a first segment extending downwardly from the platen to the base, a second segment resting on and parallel to the base and a third segment, so the first and third and second and fourth apertures respectively, are in aligned relation through the channels with the first, second, third and fourth tabs inturned, the tab folded over the platen, with the first segment of each base endwall turned upwardly, the second endwall segment turned downwardly so a third platen endwall segment and the first and third tabs and the first top tab are enclosed thereby at one end of the base means and a third platen endwell segment and the second and fourth and second top tab means are enclosed thereby at its opposite end of the base means with the top sidewall means downturned over the first sidewall and the fastener means received in the base slot means.

* * * * *